United States Patent [19]

Nelson et al.

[11] 3,968,908

[45] July 13, 1976

[54] DEVICE FOR PREVENTING LADLE NOZZLE LEAKS

[75] Inventors: Francis D. Nelson, Munster; Willard M. Presson, Merrillville, both of Ind.

[73] Assignee: Inland Steel Company, Chicago, Ill.

[22] Filed: Oct. 3, 1975

[21] Appl. No.: 619,422

[52] U.S. Cl. ..... 222/563; 266/272

[51] Int. Cl.[2] ..... B22D 41/10

[58] Field of Search..... 222/563, DIG. 7, DIG. 20, 222/DIG. 5, DIG. 1, 600; 266/42; 138/89

[56] References Cited

UNITED STATES PATENTS

| | | | |
|---|---|---|---|
| 2,115,535 | 4/1938 | O'Neil | 222/563 UX |
| 2,328,267 | 8/1943 | Freeman | 222/563 X |
| 3,511,261 | 5/1970 | Bick et al. | 222/600 |
| 3,779,742 | 12/1973 | Fehling et al. | 222/600 |

FOREIGN PATENTS OR APPLICATIONS

| | | | |
|---|---|---|---|
| 106,150 | 5/1917 | United Kingdom | 138/89 |

*Primary Examiner*—Stanley H. Tollberg
*Assistant Examiner*—David A. Scherbel
*Attorney, Agent, or Firm*—Merriam, Marshall, Shapiro & Klose

[57] ABSTRACT

A closure device for use in preventing leakage of molten steel or other metal from the nozzle of a metal ladle comprises a pair of generally vertical elongated jaw members spaced and hinged at their bottom ends to a base member, the jaws and the base member being sized to permit insertion of the assembly into the bore of the nozzle. Immediately below the base member, there is positioned a washer plate having a size sufficient to block the bore of the nozzle. Passing upwardly through the plate and extending into the space between the jaw members there is a threaded rod provided at its upper end with an enlarged head contacting the opposed inner faces of the jaw members. The lower end of the rod below the washer is threadedly engaged to a wing nut which is manually operated.

4 Claims, 4 Drawing Figures

FIG.1
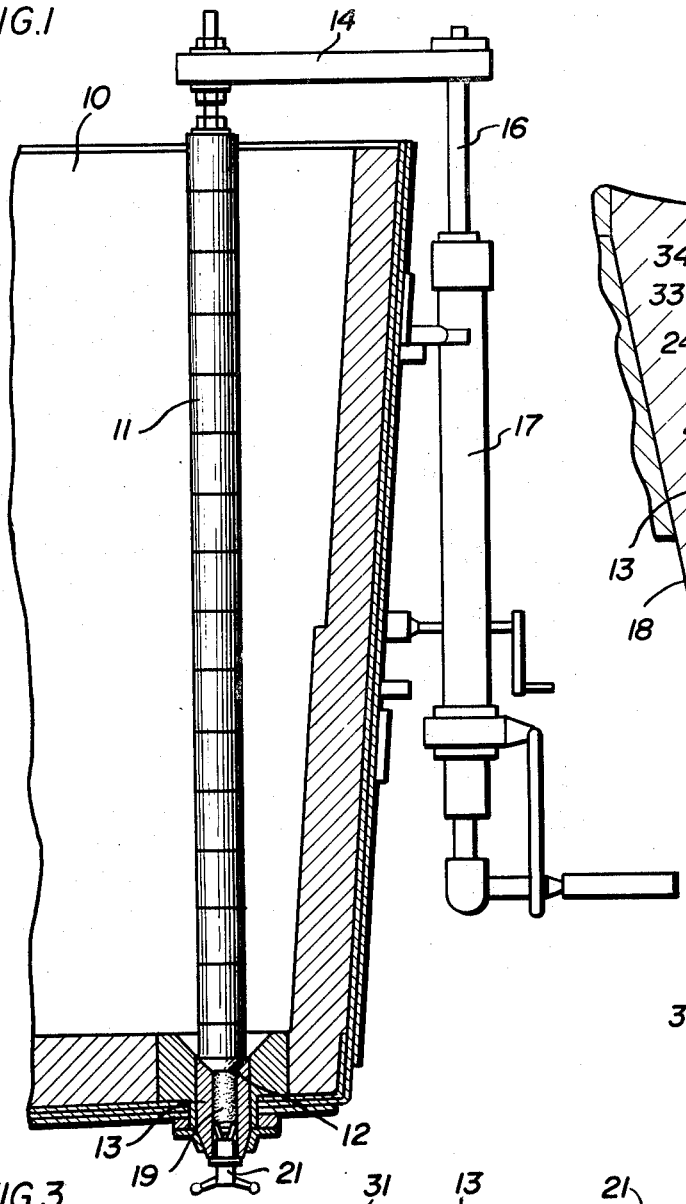
FIG.2
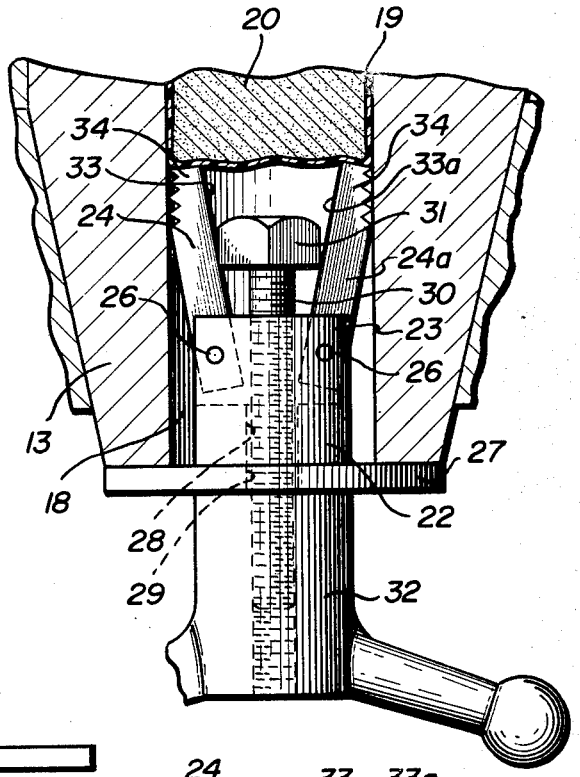
FIG.3
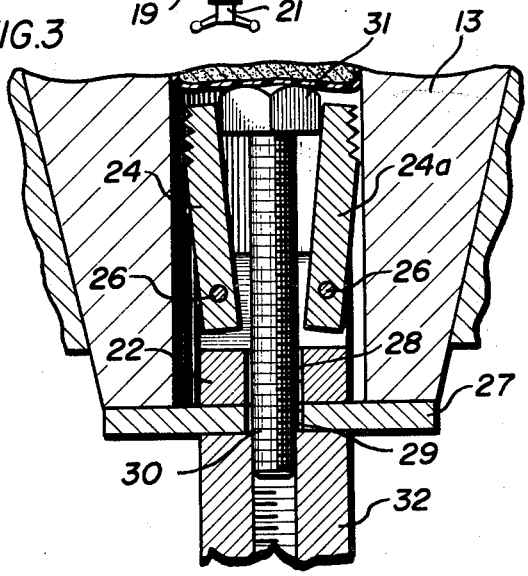
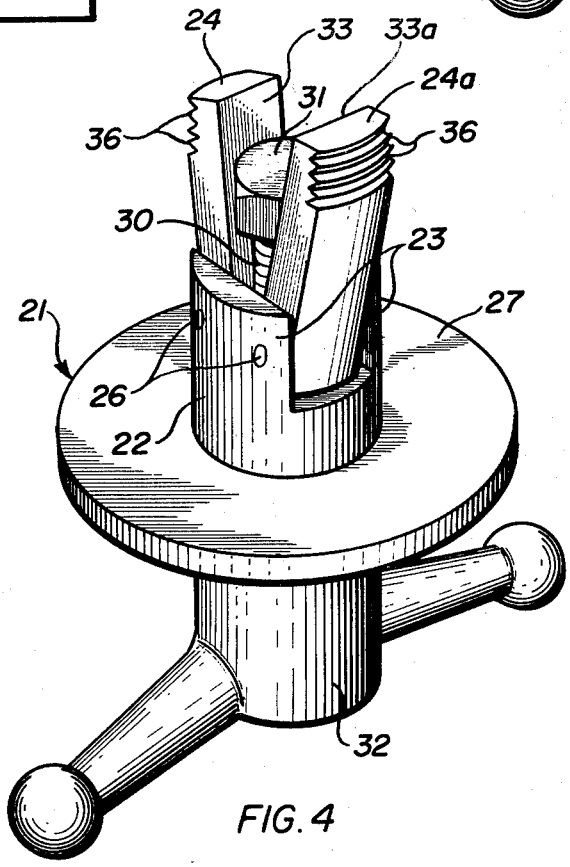
FIG. 4

DEVICE FOR PREVENTING LADLE NOZZLE LEAKS

BACKGROUND

In the steel industry, it is conventional practice to transfer the molten steel produced in a furnace to a steel ladle, from which the steel is teemed (poured) into ingots or continuous caster tundishes. The ladle is conventionally equipped with a valve in its bottom, which is used to control the flow of molten steel out of the ladle. A conventional valve employed in such ladles consists of a stopper rod assembly, comprising a vertical, refractory-covered rod extending upwardly above the top of the ladle, the bottom end of the rod being adapted to block the bore of a refractory nozzle positioned in the bottom of the ladle. Before the ladle is filled with molten steel, the lower end of the stopper rod is positioned into sealing engagement with the nozzle in the bottom of the ladle. After the ladle is filled, the flow of steel from the ladle is initiated by lifting the stopper rod by suitable means out of sealing engagement with the nozzle, permitting the steel to flow as desired.

In order to prevent leakage of molten steel out of the nozzle through the stopper rod assembly prior to teeming, which might occur as a result of an imperfect seal or of jarring of the ladle during operation, a suitable procedure has been to insert a bag enclosing a quantity of a finely divided refractory material, such as sand, into the open bore of the nozzle below the lower end of the stopper rod and to keep the bag in place in the bore of the nozzle by means of an external plug. If any molten steel escapes past the sealing end of the stopper rod into the nozzle, it contacts the refractory material and freezes in place. In order to support the bag of refractory material in place within the bore of the nozzle, tapered wooden or metal plugs making a friction fit in the bore of the nozzle have been used. Both of these types of plugs have disadvantages in use. A wooden plug is subject to being loosened by jarring or other impact or to charring as a result of the high temperatures typically existent during the operation of such ladles. On the other hand, a tapered metal plug, driven into the bore of the nozzle with sufficient force to ensure a firm engagement, has a tendency to crack the refractory material near the tip of the nozzle.

SUMMARY OF THE INVENTION

The present invention comprises an improved closure device adapted to close the bore of the nozzle and to support the bag of sand or other refractory material inserted herein. The device, formed of metal, and therefore not subject to charring as in the case of a wooden plug, is inexpensive, reliable in operation and does not tend to cause cracking of the refractory nozzle.

The device comprises a pair of generally vertically elongated jaw members spaced apart and hinged at their bottom ends to a base member, the jaws and the base member being sized to permit insertion of the assembly into the bore of the nozzle. Immediately below the base member, there is positioned a washer plate having a size sufficient to block the bore of the nozzle. Passing upwardly through the plate and extending into the space between the jaw members there is a threaded rod provided at its upper end with an enlarged head contacting the opposed inner faces of the jaw members. The lower end of the rod below the washer is threadedly engaged to a wing nut which is manually operated.

The device is operated by backing off the wing nut sufficiently to permit the jaws to fit loosely within the bore of the nozzle. The nut is then tightened, forcing the head to bear against the jaws and causing them to rotate outwardly against the wall of the bore of the nozzle, thereby securing the device firmly within the bore with the washer plate in position to block the exit of the nozzle.

DESCRIPTION OF THE DRAWING

The invention will be better understood from the following detailed description thereof, taken in conjunction with the accompanying drawings, in which:

FIG. 1 is a partial sectional view of a portion of a steel ladle showing a conventional stopper rod assembly, with the device of the invention in place in the delivery nozzle of the ladle;

FIG. 2 is an enlarged detail in partial section of the nozzle of the ladle shown in FIG. 1, showing the device of the invention secured in place;

FIG. 3 is a view similar to that of FIG. 2, showing the device of the invention with the jaws disengaged from the nozzle, as during insertion or removal of the device; and FIG. 4 is a perspective view of the device of the invention in condition to be inserted into the bore of the nozzle.

DETAILED DESCRIPTION OF THE INVENTION

As shown in FIG. 1, the device of the invention as intended to be used with a metal ladle 10 provided with a stopper rod assembly, comprising a stopper rod 11, typically consisting of a refractory-covered elongated steel rod which extends upwardly above the top of metal ladle 10. The lower end of stopper rod 11 is provided with a stopper head 12 having a contour which matches that of the upper surface of nozzle 13 installed in the bottom of ladle 10. The upper end of stopper rod 11 is connected by means of goose neck 14 to slide 16, which in turn can be moved vertically by means of a control system 17 of conventional type. By suitable operation of control system 17, slide 16 can be moved upwardly or downwardly, causing head 12 to move into or out of sealing engagement with the upper end of nozzle 13, as desired.

In the condition shown in FIG. 1, stopper head 12 is in sealing engagement with nozzle 13. In order to contain leaks of molten metal past the seal between the stopper head and the nozzle, there is inserted into the bore 18 of nozzle 13 a quantity of a refractory material 20 such as sand, clay or finely ground refractory brick enclosed in a bag 19, suitably formed of a plastic or other similar material. On contact with molten metal, the bag is consumed permitting the molten metal to freeze onto the finely divided refractory material, thus preventing the escape of the metal from the ladle. The bag of refractory material is held within the bore of nozzle 13 by means of the closure device 21 of the invention.

A detail of the closure device 21 of the invention in place within the bore of nozzle 13 is shown in FIG. 2. The device comprises a base member 22 which is suitably in the form of a cylindrical plug having a diameter which permits its insertion within the bore 18 of nozzle 13. The upper end of base member 22 is provided with a channel defined by two parallel upstanding arms 23, within which are positioned a pair of symmetrical jaws 24 and 24*a*, each of which is hinged for rotation about pin 26 passing through the lower end of each jaw, the ends of the pins being fixed to arms 23.

Arranged immediately below and in contact with the lower end of base member 22 is a metal washer 27 having a diameter sufficient to block the bore 18 of nozzle 13. Base member 22 and washer 27 are provided with central holes 28 and 29 respectively, through which is passed bolt 30, the head 31 of the bolt being positioned between the adjacent inner faces 33 and 33*a* of jaws 24 and 24*a*. The holes 28 and 29 in base member 22 and washer 27 are larger than the diameter of the bolt and do not engage the threads thereof. The portion of the bolt extending below washer 27 is threadedly engaged to wing nut 32. The width across the flats of head 31 of bolt 30 is greater than the maximum distance separating the inner faces 33 and 33*a* of jaws 24 and 24*a* along a line passing through pins 26. Accordingly, the head of the bolt acts as a wedge which forces jaws 24 and 24*a* apart to a degree which is dependent on the distance of the head 31 of bolt 30 above base member 22. By turning wing nut 32 in a direction to decrease the distance between the nut and the head of the bolt, head 31 of bolt 30 is caused to move in a downward direction, thus forcing the upper outer faces of jaws 24 and 24*a* into engagement with the wall of bore 18 in nozzle 13.

FIG. 2 shows the device of the invention after it has been secured in place in the bore of nozzle 13 by suitable manipulation of wing nut 32. To increase the gripping action of jaws 24 and 24*a* against nozzle, it is advisable to taper the upper outer faces of the jaws and to provide the tapered surfaces 34 with serrations 36, as shown. The tapered surfaces 34 of the jaws permit a larger number of serrations to contact the bore of the nozzle, thus improving the efficiency of the seal.

It is preferred that the head 31 of bolt 30 have a shape, e.g., hexagonal or square, which permits line or face, as opposed to point, contact between the head and the inner faces 33 and 33*a* of jaws 24 and 24*a*. In addition to providing more contact with the jaws, a hexagonal or square head also prevents relative rotation between the head and the jaws, which cannot be permitted to occur while wing nut 32 is rotated to tighten the assembly.

FIG. 3 shows the device of the invention after insertion into nozzle 13, but prior to tightening. As shown, head 31 of bolt 30 is elevated sufficiently to permit jaws 24 and 24*a* to approach each other enough to permit the entire assembly to be inserted into bore 18. As wing nut 32 is rotated to cause bolt 30 to be drawn downwardly, head 31 of the bolt forces the jaws into gripping engagement with the nozzle, as shown in FIG. 3.

To remove the closure device prior to pouring metal from the ladle, wing nut 32 is loosened, permitting washer 27 and base member 22 to drop below the outlet of nozzle 13. An upward force on bolt 30 will then cause head 31 of the bolt to rise, releasing the wedging action of the head against jaws 24 and 24*a* and thus loosening the closure for removal.

The foregoing detailed description has been given for clearness of understanding only, and no unnecessary limitations should be understood therefrom, as modifications will be obvious to those skilled in the art.

What is claimed is:

1. A closure device for preventing leakage of molten metal from a ladle provided with a stopper rod assembly including a stopper rod and a nozzle having a bore which is blocked by said stopper rod to prevent flow of said metal, said device comprising:

a base member;

a pair of spaced elongated generally parallel gripping jaws, the outer surfaces of said jaws being adapted to grip the bore of said nozzle, one end of each jaw being pivotally connected to said base member, the dimensions of said base member and said jaws and the spacing between said jaws being such as to permit the insertion of said base member and jaws into the bore of said nozzle;

a threaded rod passing through a hole in said base member and extending into the space between said jaws, said rod having an enlarged head positioned between said jaws, the width of said head being larger than the spacing between said jaws at the points of connection to said base member, whereby said jaws are forced apart by contact with said head to an extent which increases as said head approaches the points of connection of said jaws to said base member;

a washer plate having a central hole through which said rod passes, said washer having a diameter larger than the bore of said nozzle and being positioned adjacent the outlet end of said nozzle; and a nut engaging the threads of said rod adjacent said washer.

2. The device of claim 1 in which said base member comprises two parallel arms extending therefrom, said arms defining a channel in which one end of each of said jaws is positioned; and a pair of pins each of which pivotally connects said one end of each of said jaws to said arms.

3. The device of claim 1 in which said head of said rod makes line contact with each of said jaws.

4. The device of claim 1 in which the outer surfaces of said jaws comprise an inwardly tapered section, said section being provided with serrations adapted to grip the bore of said nozzle.

* * * * *